United States Patent [19]

Waller

[11] Patent Number: 4,993,716

[45] Date of Patent: Feb. 19, 1991

[54] GOLF STANCE ALIGNMENT DEVICE

[76] Inventor: Malcolm C. Waller, 4247 Shallowford Rd., Chattanooga, Tenn. 37411

[21] Appl. No.: 512,210

[22] Filed: Apr. 20, 1990

[51] Int. Cl.[5] ..... A73B 69/36

[52] U.S. Cl. ..... 273/183 B; 273/188 R; 273/77 R; 273/187 R

[58] Field of Search ..... 273/188 R, 188 A, 189 R, 273/189 A, 190 R, 190 A, 190 B, 183 B, 187 R, 77 R; 434/252

[56] References Cited

U.S. PATENT DOCUMENTS

| | | | |
|---|---|---|---|
| 1,530,519 | 3/1925 | Remington | 273/188 R |
| 1,936,143 | 11/1933 | Shea | 273/190 R |
| 3,138,388 | 6/1964 | Herold | 273/188 R |
| 4,659,084 | 4/1987 | Vuick | 273/188 R |
| 4,895,372 | 1/1990 | Muller | 273/188 R |

*Primary Examiner*—George J. Marlo
*Attorney, Agent, or Firm*—Berman, Aisenberg & Platt

[57] ABSTRACT

A golf stance alignment device is a practice apparatus for insuring that a golfer takes the proper stance when addressing the ball. The device is adjusted to touch the golfer at the shoulders and just below the knees when the golf club is placed in the marked position for the particular club being used and the golfer takes up position as if to hit the ball. The device is adjustable in extension and angle according to the golfer and the club being used. Graduations on the device enable it to be reset with the same angles and lengths for repeated practice sessions. After standing against the device, the golfer then steps away, takes up the same stance, and plays the golf ball while remembering the stance from the correctly aligned position previously supported at the shoulders and knees by the device.

14 Claims, 3 Drawing Sheets

FIG. 3
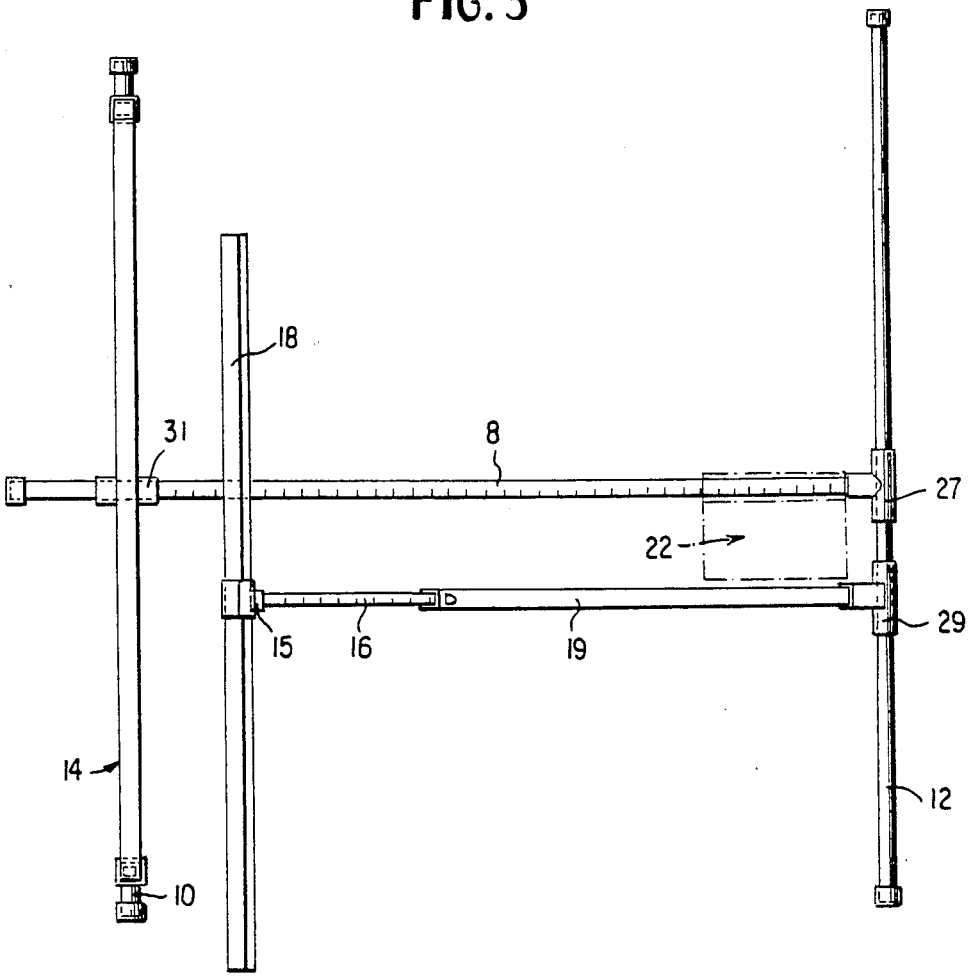
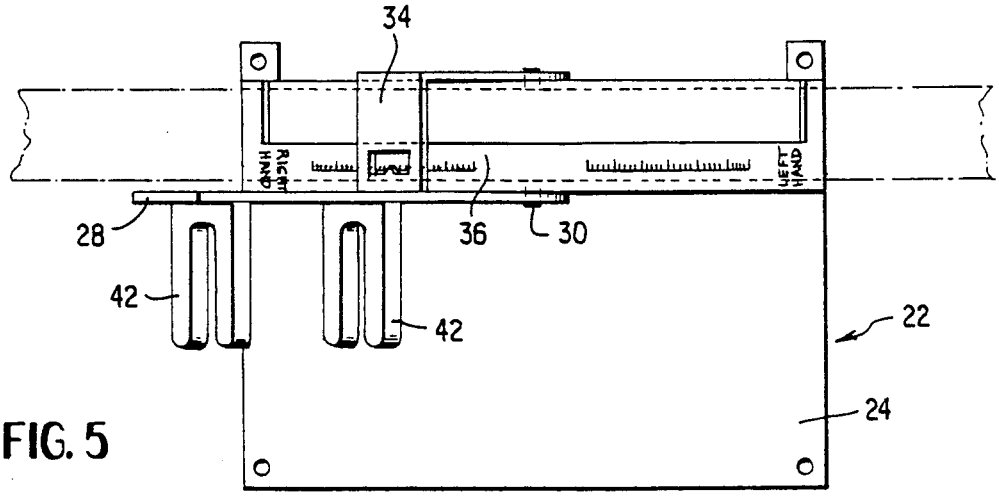
FIG. 5

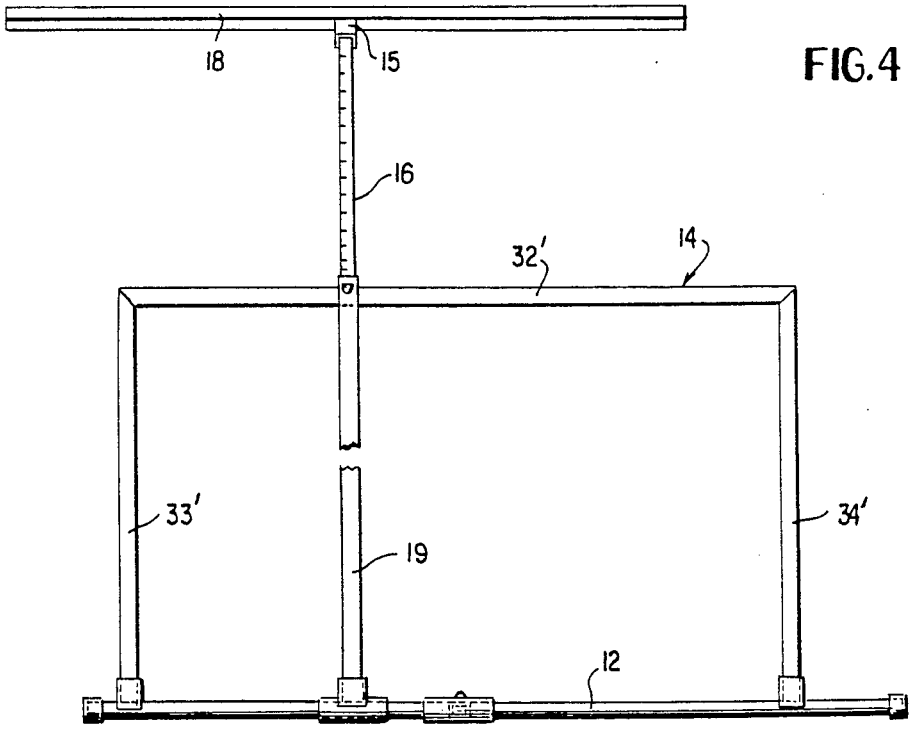
FIG. 4
FIG. 6
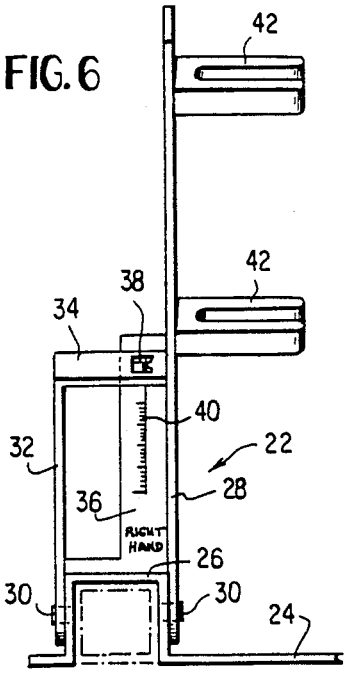
FIG. 7
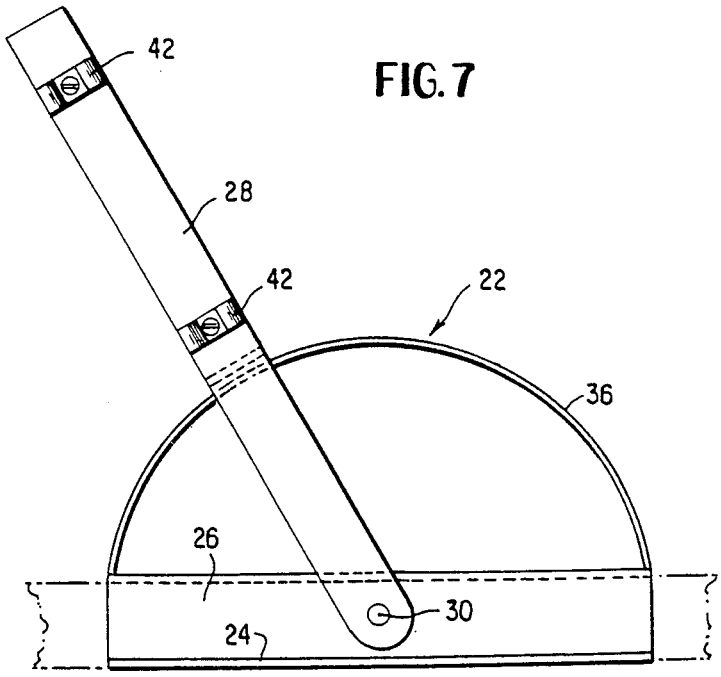

GOLF STANCE ALIGNMENT DEVICE

FIELD OF THE INVENTION

The invention relates to apparatus for training golfers to stand correctly when addressing golf balls.

BACKGROUND OF THE INVENTION

Known devices train a golfer in the way in which a club should be gripped and the way in which a golfer's body should be moved when hitting golf balls. None of these devices defines the proper initial position to be taken when addressing a golf ball by providing supports defining alignment of the knees and shoulders of a golfer in the proper stance for hitting the ball.

Herold U.S. Pat. No. 3,138,388, describes a device for coordinating the pivotal movement of a golfer's shoulders and hips. Zega, U.S. Pat. No. 3,730,531, also shows a golf swing practice device. The patent to Bryson, U.S. Pat. No. 3,767,204, describes a device which supports the front of the thighs of a golfer. The patent to Chen, U.S. Pat. No. 4,318,546, describes a golf club swing training device which is strapped around the shoulders and waist of a user. Vuick, U.S. Pat. No. 4,659,084, is directed to the knee and head positions only. Cox, U.S. Pat. No. 4,758,000 also does not address the front shoulder position of a golfer during the swing. These patents each address a golfer's swing. None describes a combined knee and shoulder support for alignment of stance, as described herein.

SUMMARY OF THE INVENTION

A golf stance alignment device is a practice apparatus for insuring that a golfer takes the proper stance when addressing the ball. The device is adjusted to touch the golfer at the shoulders and just below the knees when the golf club is placed in the marked position for the particular club being used and the golfer takes up position as if to hit the ball. The device is adjustable for the size of the golfer and for the club being used. Graduations on the device enable it to be reset with the same angles and lengths for repeated practice sessions. After standing against the device, the golfer then steps away, takes up the same stance, and plays the golf ball while remembering the stance from the correctly aligned position previously supported at the shoulders and knees by the device.

It is an object of the invention to provide a golf practice device which reinforces knowledge of a properly aligned stance for addressing the ball.

BRIEF DESCRIPTION OF THE DRAWINGS

FIG. 3 is a top plan view of a device of FIG. 1.

FIG. 4 is a front elevation view of a device of FIG. 1.

FIG. 5 is a top plan view of a golf club support for use in conjunction with the apparatus of FIG. 1.

FIG. 6 is an end view of the support of FIG. 5.

FIG. 7 is a side view of the support of FIG. 5.

DETAILED DESCRIPTION OF THE INVENTION

Figure 1:
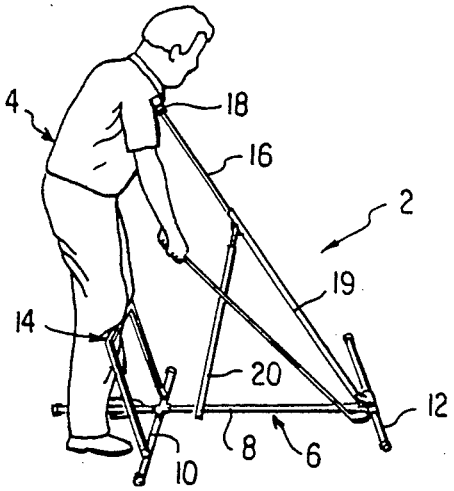
FIG. 1 is a perspective view of a device of the invention, in use by a golfer.
Figure 2:
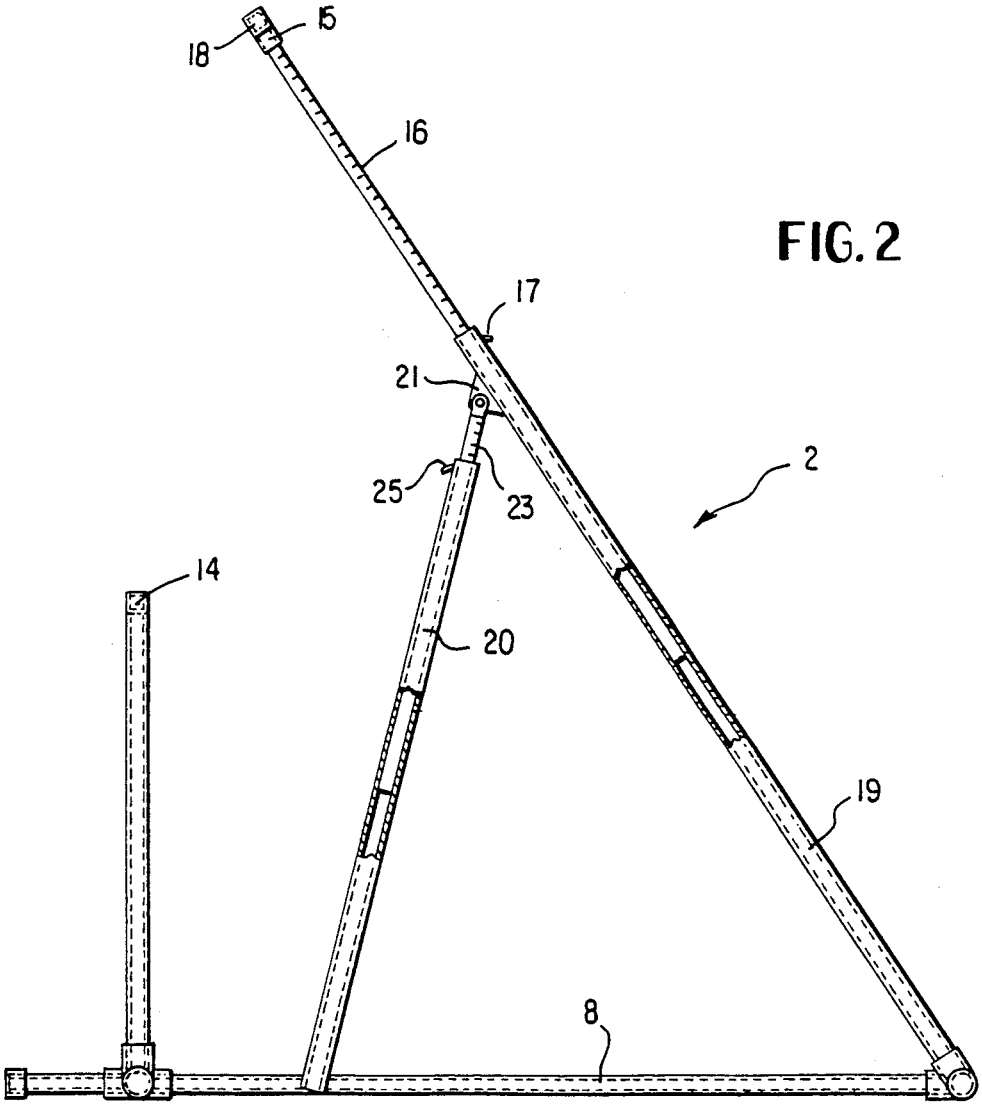
FIG. 2 is a side elevation view of the device of FIG. 1.

A major factor in successfully playing golf is the position the golfer takes when addressing the ball. A portable golf stance alignment device of the invention supports a golfer's shoulders and knees and orients the golfer's head, shoulders, sternum, spine, hips, knees, legs and feet together with his arms, hands and club in proper relationship to address the ball. The golfer's entire posture and balance are thus properly coordinated in static position with respect to a certain target, prior to practicing a golf swing or hitting a golf ball.

A device of the invention checks the static position of the golfer as the ball is addressed. The golfer does not move the club or hit the ball while using the device. The device checks and reinforces use of a properly aligned stance, with the correct body position, by supporting the golfer's shoulders and knees in position for playing the ball. The golfer then steps away from the device, takes up the same stance and plays the golf ball while remembering the stance from the correctly aligned position previously supported at the shoulders and knees by the device. The golf stance alignment device is used for practice and familiarizes a golfer with the correct golf stance and reinforces the golfer's knowledge of that correct position.

The feel of the device on a golfer's shoulders and knees and the way in which the body is oriented and coordinated for a correct swing with respect to the target, while using the device, are duplicated when the golfer steps away from the device and addresses the ball.

A golf stance alignment device according to this invention may be used repeatedly between practice swings or drives. In addition, the device may be used intermittently when a golfer feels the need to remind himself of the correct stance for successful, properly coordinated play. The device is useful for beginning, intermediate or experienced players and may be used at home, at a driving range, golf course or elsewhere. A golf stance alignment device of the invention may be adapted for right-handed or left-handed users, and is described below with respect to right-handed users.

A portable golf stance alignment device of the invention includes a first bar having a telescoping upper end portion for engaging shoulders of a golfer holding a golf club standing in aligned position for hitting a golf ball, and a lower end portion on the ground. A supporting strut of adjustable length is hinged, or otherwise attached, to the telescoping first bar to support the bar in position. The lower end of the first bar is attached to the framework of the device which rests on the ground in use.

An angularly adjustable inverted U-shaped member is adjusted to engage the knees of the golfer when the golfer is standing in aligned position for hitting the golf ball with his shoulders supported by the first bar and while holding a golf club in position for hitting the ball. The lower ends of the inverted U-shaped member are attached to another bar which forms part of the framework of the device and which rests on the ground when the device is used.

The framework which rests on the ground when the device is used also includes a bar which connects the shoulder- and knee-engaging members together. The device is collapsible and portable.

With reference to FIGS. 1 to 7, in which like numerals represent like parts, golf stance alignment device 2 is illustrated in FIGS. 1 to 4. FIG. 1 shows golfer 4 using device 2. As shown in detail in FIGS. 2 to 4, device 2 includes a base 6 which rests on the ground. Base 6 is composed of bar 8 crossed by bars 10 and 12. The golfer stands with one foot on each side of bar 8, with the left foot placed on the left side of, and substantially parallel to, bar 8 and the right foot placed on the right side of, and substantially parallel to, bar 8. Both feet are behind bar 10. The position of bar 10 along bar 8 is adjustable so that the distance between bar 10 and bar 12 may be changed to adjust the distance between the club head and the ball position in relation to the position and alignment of the feet parallel to the target. The golf club is placed to the right of bar 8, adjacent bar 12. Bar 8 is marked for each golf club and the club should be placed against the mark corresponding to the club used. Thus, a slightly different body alignment is achieved according to the club used, to maximize the benefit of the choice of a particular club for a particular shot.

In a non-limiting example, bar 8 is 48 inches long and is marked in 1-inch divisions from adjacent bar 10 to about 5 in. from bar 12, as shown in FIG. 3. The positions on bar 8 nearest bar 10 are marked 48, 47, 46 etc., marking the number of inches of extension of bar 10 from bar 12, thus defining the location of bar 10 with respect to the length of bar 8. Bar 8 is marked in this manner down to about 24 inches from an initial position of bar 10, and then bar 8 is marked according to the proper position of the club being used. Thus, the 1-inch increments of bar 8 are next successively marked as follows: SW (sand wedge), PW (pitching wedge), 9I (9 iron), 8I, 7I, 6I, 5I, 4I, 3I, 2I, 1I, 5W (5 wood), 3W, D (driver), toward bar 12. For example, a golfer using the device to practice the position for addressing a ball with a 4 iron will place that club adjacent the 4I mark and align his body for that particular golf club. The device is used similarly for practicing and checking body alignment using other golf clubs.

Alignment bar 14 is moved into place next to the golfer's knees or legs to check the knee, hip and leg alignment and the leg flex parallel to bar 12. Then upright 16 is extended in length to rest in the center of the golfer's chest with bar 18 resting against the shoulders to check that the shoulders are parallel to bar 12 and to check that the head and sternum point behind the ball position.

The amount of extension of upright 16 is noted according to numbered, graduated markings along its length. Adjustable support 20 (which also has numbered, graduated markings along its length) is locked at the proper height adjustment of upright 16 for the user, so that the head, shoulder, hand and arm position are correct and the posture and balance are also correct at the same time.

A golfer records the proper settings of the adjustments of bars 8, 16 and 20 of the device and sets each bar at this known correct length for himself. This simplifies setting up the device each time it is used, even if the same device is used by several players, such as at a driving range. The extended length of each bar is locked in place using a quick release adjustment known in the art, such as a button release or lever release.

When the golfer checks his static position ready to address the ball, the head, shoulders, sternum, spine, arm, hands, hips, legs, knees and feet are checked in relation to the position of the club with respect to the ball position parallel to the target line. Posture and balance are further checked by checking the distance from the club head to the feet.

FIGS. 5 to 7 show an optional attachment 22 for using with device 2, or separately. Attachment 22 acts as a protractor for lie angle and for holding the golf club for custom fitting clubs for the left hand or right hand. Attachment 22 is positioned as shown in FIG. 3 when used with device 2. Alternatively, attachment 22 may be used alone. Attachment 22 includes base 24, shown in FIGS. 5 and 6, which has an upstanding channel 26 along its length. The base may be about $5\frac{1}{4}$ in. wide and 8 in. long. Channel 26 may be a $1\frac{1}{4}$ in.$\times$8 in. channel attached to a 4 in.$\times$8 in. plate. Bar 28, which may be about 9 in. long, rotates about pivots 30 attached to channel 26. Bar 28 is preferably reinforced by supporting bars 32 and 34 forming a rigid rotating structure which travels easily around arc 36 for taking measurements of a golf club. Bar 34 includes an aperture 38 for viewing scale 40, marked in degrees, on arc 36. Scale 40 is marked, in degrees, on the curved strip forming arc 36 (which may be of 4 in. radius), to indicate the angle of a golf club handle from the horizontal when the golf club is placed in attachment 22 in position for measurement. Attachment 22 is marked for a right-handed or a left-handed golfer and may be reversed in position accordingly. Molded rubber open holders 42 are attached to bar 28 at appropriate heights to hold the shaft of a golf club in proper position for measurement and adjustment.

In a non-limiting example, device 2 is portable and is hinged for folding when not in use. Upright bar 16 may be $1\frac{1}{8}$ in. square cross-section tubing, with graduated markings, attached to a T-fitting 15 and fitted with a quick-release lever 17 for telescoping into $1\frac{1}{4}$ in. cross-section tubing outer bar 19. Inner bar 16 may be about 45 in. in length and outer bar 19 may be about 36-in. in length. Cross-bar 18 fits through T-fitting 15 for connection with upright bar 16. Bracket 21 fixed to bar 19 allows graduated inner bar 23 to swivel with respect to bar 19 for folding. Inner bar 23 telescopes into outer bar 20, and may be marked with numbered or lettered graduations to indicate the preferred extended position of inner bar 23, in use. Inner bar 23 may be square tubing 20 in. in length and outer bar 20 may be square tubing 32 in. in length and inner bar 23 slides within outer bar 20 to a position held by quick-release lever 25.

Bar 12 may be round tubing, about 48 in. in length, which passes through T-joints 27 and 29, as shown in FIG. 3. Bar 12 stabilizes and supports the device. T-joint 27 is positioned at about the mid-point of bar 12 and T-joint 29 is positioned about 5 in. to the right of T-joint 27. For a left-handed player, bars 8 and 16 are interchanged (using release buttons) so that bar 19 engages T-joint 27 and bar 8 engages T-joint 29.

Joint 31 is used for sliding bar 10 along the length of bar 8 according to the optimum position for the golfer's feet. Bar 10 , which may be about 40 in. in length, may be made in two halves, if required.

Inverted U-shaped member 14 may be made of interlocking bars 32', 33' and 34', if required for ease of assembly and breakdown.

The device is preferably made of metal or plastic tubing which may be of round and/or square, oval or other cross section. Other materials and shapes will be apparent to those skilled in the art. Release catches, end caps and other fittings are typically those known in the art. The bars of the device are designed with sufficient tolerance to allow the telescoping portions to slide in and out smoothly, without excess side motion or rotation.

While the invention has been described above with respect to certain embodiments thereof, it will be appreciated that variations and modifications may be made without departing from the spirit and scope of the invention.

What is claimed is:

1. A golf stance alignment device for checking the stance, of a golfer holding a golf club standing in aligned position for hitting a golf ball, said device comprising a framework which connects the following parts:

adjustable means for supporting shoulders of a golfer holding a golf club standing in aligned position for hitting a golf ball;

adjustable means for supporting knees of said golfer holding a golf club standing in aligned position for hitting the golf ball; and adjustable means for aligning the position of the golf club according to the club used when said golfer is standing in said aligned position.

2. A golf stance alignment device according to claim 1 further comprising a ground engaging framework from which said shoulder and knee supporting means extend.

3. A golf stance alignment device according to claim 2 wherein said ground engaging framework comprises a first ground engaging support for said shoulder supporting means and a second ground engaging support for said knee supporting means, said first and second ground engaging supports being connected by a third ground engaging support.

4. A golf stance alignment device according to claim 3 wherein said third ground engaging support comprises elongated means for aligning positions of the golfer's feet.

5. A golf stance alignment device according to claim 3 wherein said shoulder supporting means is further supported by a strut which engages the shoulder supporting means at its upper end and which engages the ground at its lower end when the device is in working position.

6. A golf stance alignment device according to claim 3 wherein said adjustable means for aligning the position of the golf club according to the club used when said golfer is standing in said aligned position comprises said third ground engaging support, whereby the golf club is positioned adjacent said third ground engaging support in said aligned position.

7. A golf stance alignment device according to claim 6 further comprising means for aligning a golf club with optimum lie angle.

8. A golf stance alignment device according to claim 7 wherein said aligning means further comprises means for engaging a golf club.

9. A portable golf stance alignment device comprising:

telescoping means comprising a first end portion for engaging shoulders of a golfer holding a golf club standing in aligned position for hitting a golf ball and a second end portion for engaging the ground;

strut means engaged with said telescoping means for supporting said telescoping means in position;

first ground engaging means for supporting said second end portion of said telescoping means;

angularly adjustable means for engaging knees of said golfer holding a golf club standing in aligned position for hitting the golf ball;

second ground engaging means for supporting said angularly adjustable means;

third ground engaging means for connecting said first and second ground engaging means.

10. A golf stance alignment device according to claim 9 further comprising means for aligning lie angle of a golf club engaged with said third ground engaging means.

11. A golf stance alignment device according to claim 10 wherein said aligning means further comprises means for engaging a golf club.

12. A golf stance alignment device according to claim 9 wherein said telescoping means comprises a graduated extension.

13. A golf stance alignment device according to claim 9 wherein said strut means comprises a graduated telescoping extension.

14. A golf stance alignment device according to claim 9 wherein said angularly adjustable means is a U-shaped member.

* * * * *